US005588448A

United States Patent [19]

Photakis

[11] Patent Number: 5,588,448

[45] Date of Patent: Dec. 31, 1996

[54] SMOKING ARTICLE HOLDER

[76] Inventor: John G. Photakis, 53 Winifred Ave., Worcester, Mass. 01602

[21] Appl. No.: 470,913

[22] Filed: Jun. 6, 1995

[51] Int. Cl.[6] ..... A24F 13/12

[52] U.S. Cl. ..... 131/259; 473/387; 473/402

[58] Field of Search ..... 131/240.1, 241, 131/257, 259, 260; 273/33, 212; 473/387, 402

[56] References Cited

U.S. PATENT DOCUMENTS 1,840,210 1/1932 Reekers ..... 131/257
1,874,045 8/1932 Jefferies ..... 131/257 X
3,001,529 9/1961 Watson ..... 131/257
4,838,285 6/1989 Petrone ..... 131/259

*Primary Examiner*—William H. Grieb
*Attorney, Agent, or Firm*—Blodgett & Blodgett P.C.

[57] ABSTRACT

A smoking article holder is disclosed. The holder is to be used with both a golf tee having a head portion, and with a smoking article, such as a cigar. The smoking article holder has a generally oblong upper member with an elongated, concave upper surface and a lower surface. The upper surface is adapted for receiving at least a part of the smoking article. The holder also has a lower member which depends from the lower surface of the upper member, intermediate its length. The lower member is adapted to receive at least a part of the head portion of the golf tee.

8 Claims, 1 Drawing Sheet

SMOKING ARTICLE HOLDER

BACKGROUND OF THE INVENTION

The field of invention relates generally to receptacles for smoking articles, and more particularly, pertains to receptacles which can be used in an open area of ground.

Today, there is a marked trend among golfers to smoke cigars while playing their game, thereby enhancing their enjoyment. The time spent waiting for their partners or travelling to the next hole provides ample opportunity to enjoy a smoke, without interfering with their game.

A well known problem in pursuing the pleasure of a cigar during a golf game is that there are few if any places on a golf course for the golfer to rest his cigar, when necessary. As such, the golfer is typically forced to place his cigar on the grass. However, this exposes the end of the cigar that is placed in the mouth to chemicals, such as herbicides, dirt and insects. Further, placing a cigar in the grass can lead to its loss.

Generally, it is not practical to bring along an ashtray or other retaining means because of the bulk involved with such a device.

Similar problems can be encountered by spectators of amateur sports. Children are becoming increasingly involved in sports because of the modern trend towards fitness. Additionally, the recent popularity of soccer in this country has meant that the average parent spends a great deal of time sitting in a folding chair on the edge of a field. Again, there are no provisions for ashtrays of any type, and the same problems result when the spectator needs his or her hands free such as for applauding. If a cigar or other smoking article is merely rested on the grass, the problems mentioned above are encountered.

These and other difficulties have been obviated in a novel manner by the present invention.

It is, therefore, a principal object of the invention to provide a novel smoking article holder that will allow for convenient access to the smoking article.

Another object of this invention is the provision of such a holder that will prevent the smoking article from having contact with dirt, chemicals and insects.

A further object of the present invention is the provision of such a holder that will prevent loss of the smoking article.

It is a further object of the present invention to provide a novel smoking article holder that is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

It has now been found that the foregoing and related objects may be readily attained in a smoking article holder that is to be used with both a golf tee, having a head portion, and with a smoking article, such as a cigar. The golf tee has a head portion.

The smoking article holder has a generally oblong upper member with an elongated, concave upper surface and a lower surface. The upper surface is adapted for receiving at least a part of the smoking article.

The holder also has a lower member which depends from the lower surface of the upper member, intermediate its length. The lower member is adapted to receive at least a pan of the head portion of the golf tee.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
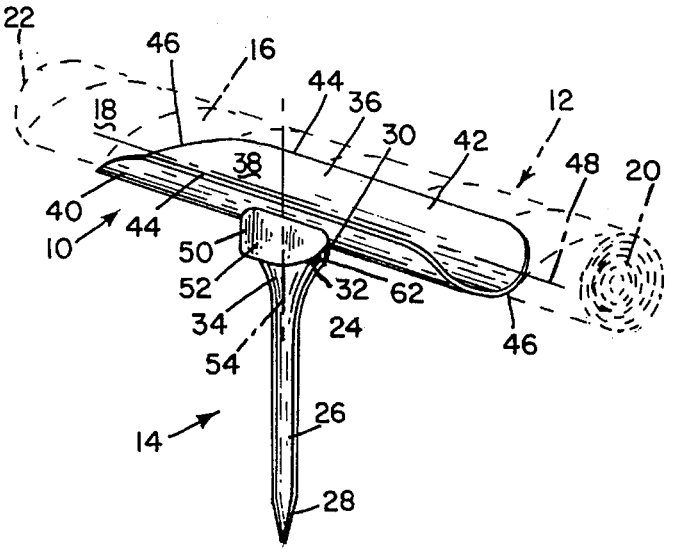
FIG. 1 is a perspective view of a smoking article holder, embodying the principals of the present invention, shown with a standard golf tee mounted therein and with a smoking article, in the form of a cigar, mounted thereon and shown in phantom line.

With reference now to the drawings, there is shown in FIG. 1, a smoking article holder, embodying the principles of the present invention, and generally indicated by the reference numeral 10. A smoking article, generally indicated by the reference numeral 12, and in the form of a cigar, is shown mounted on the smoking article holder 10. The term "smoking article", as used in this application, can include a cigar, cigarette or pipe. A standard golf tee, generally indicated by the reference numeral 14, is shown mounted within the smoking article holder 10.

The smoking article or cigar 12 has a generally cylindrical portion 16 with an outer surface 18. The cigar 12 has a first end 20 that is generally the end that is lit, and a second end 22 for placement in the mouth (not shown) of the user (not shown).

Figure 4:
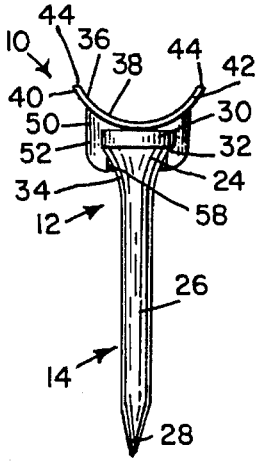
FIG. 4 is an end view of the smoking article holder and tee of FIG. 3, looking in the direction of the arrow 4.
Figure 6:
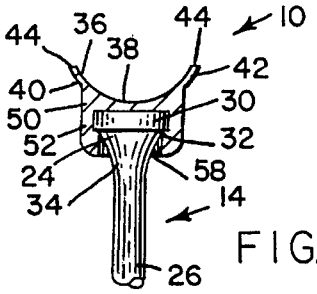
FIG. 6 is a vertical cross sectional view of the smoking article holder of FIG. 3, taken along the line 6—6 thereof, looking in the direction of the arrows, and showing the tee of FIG. 3, not in section.
Figure 3:
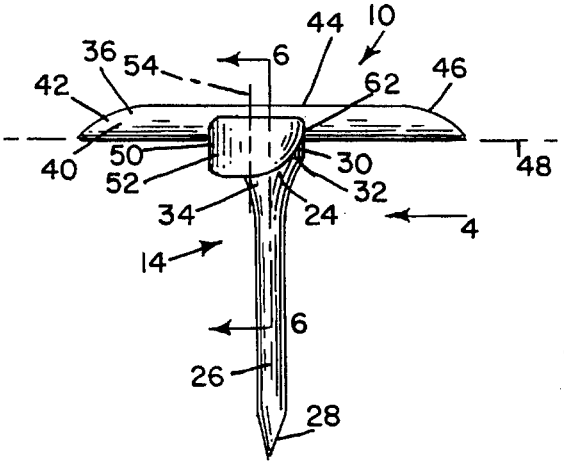
FIG. 3 is a side elevational view of the smoking article holder and tee of FIG. 1.
Figure 7:
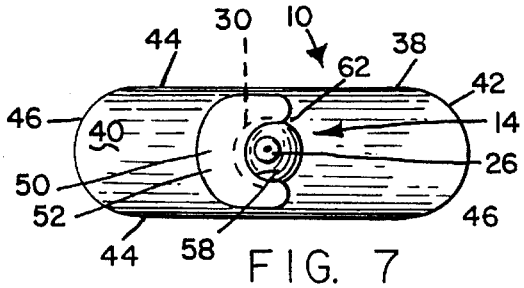
FIG. 7 is a bottom plan view of the smoking article holder and tee of FIG. 3.

Referring especially to FIGS. 1, 4 and 6, it can be seen that the standard golf tee 14 has a head portion 24 and a shank portion 26 with a point 28, to facilitate placement of at least a part of the shank portion 26 of the tee 14 in the ground (not shown). The head portion 24 has an upper cylindrical portion 30 with a bottom surface 32, and further has a tapered portion 34 that tapers inwardly from the bottom surface 32 to the shank portion 26.

Referring to FIGS. 1–7, it can be seen that the smoking article holder 10 of the present invention has a generally oblong upper member 36. The upper member 36 has an elongated concave upper surface 38 and a lower surface 40. The upper surface 38 is adapted for receiving the outer surface 18 of the cylindrical portion 16 of the smoking article 12.

Figure 2:
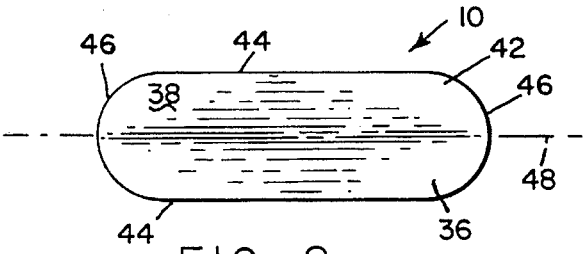
FIG. 2 is a top plan view of the smoking article holder and tee of FIG. 1.
Figure 5:
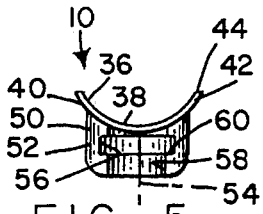
FIG. 5 is a view similar to FIG. 4, but with the tee removed from the smoking article holder of FIG. 3.

As is best seen in FIGS. 1 and 2, the upper member 36 is in the form of a generally arcuate and oblong panel 42 whose long sides 44 are parallel, and whose short sides 46 are outwardly arcuate. The long sides 44 are elevated above the central longitudinal axis 48 of the oblong panel 42 to provide the panel 42 with a C-shaped cross-section, as best seen in FIG.6.

A lower member 50 of the smoking article holder 10 depends from the lower surface 40 of the upper member 36, intermediate its length. The lower member 50 is adapted to receive at least a part of the head portion 24 of the golf tee 14.

The lower member 50 has a cylindrical body 52, with a central longitudinal axis 54 that is at right angles to the central longitudinal axis 48 of the oblong panel 42. A large bore 56 is provided along the central longitudinal axis 54 of the cylindrical body 52, commencing at a point adjacent the juncture of the cylindrical body 52 and the oblong panel 42 and extending downwardly a distance approximately equal to the height of the upper cylindrical portion 30 of the head portion 24 of the tee 14. The diameter of the large bore 56 closely corresponds to the diameter of the upper cylindrical portion 30.

Commencing at the lower end of the large bore 56, and contiguous therewith, is a small bore 58 that extends downwardly along the central longitudinal axis 54 to the lowermost point of the cylindrical body 52. The small bore 58 is configured and dimensioned to receive at least a part of the tapered portion 34 of the head portion 24 of the tee 14.

At the juncture of the large bore 56 and the small bore 58 is a shoulder 60 for seating the lower surface 32 of the upper cylindrical portion 30 of the head portion 24 of the tee 14.

A cut-out 62 in the side of the cylindrical body 52 allows for lateral access to the small bore 58 and the large bore 56. The cutout 62 is dimensioned and configured to allow lateral passage of the upper cylindrical portion 30 of the head portion 24 of the tee 14 into the large bore 56 and lateral passage of at least a portion of the inwardly tapered portion 34 of the head portion 24 of the tee 14 into the small bore 58, when the portion of the cylindrical body 52 adjoining the cut out 62 is resiliently deflected to slightly expand the size of the cut out 62.

In construction, the smoking article holder 10 is preferably fabricated from any of several synthetic resins and by the process of injection molding. It is important that the synthetic resin selected be relatively resilient to permit the deflection described above. Additionally, it will be noted that the upper member 36 and the lower member 50 are preferably integral, but could be fabricated separately and adhered to each other.

The invention having been thus described, the operation will now be clear to those of ordinary skill in the art as described below.

A user laterally inserts at least a part of the head portion 24 of the tee 14 into the large bore 56 and the small bore 58 in the manner described above. Subsequently, the point 28 on the shank 26 of the tee 14 is used to insert at least a portion of the shank 26 into the ground (not shown). The elongate concave upper surface 38 of the upper member 36 of the smoking article holder 10 will thereby be oriented in a generally horizontal manner. The cylindrical portion 16 of the smoking article 12 is then placed in the elongated concave upper surface 38 such that both the first lit end 20 and the second end 22 extend beyond the upper surface 38 of the upper member 36. If the smoking article 12 has become too short to permit both the first end 20 and the second end 22 to extend as such, then the first lit end 20 could be placed upon the upper surface 38 with the second end 22 extending beyond the upper surface 38. When the user is done with the smoking article holder 10, the tee 14 can be extracted laterally from the lower member 50 and the smoking article holder 10 and the tee 14 can be conveniently stored.

Thus, it can be seen from the foregoing detailed specification and attached drawings that the smoking article holder of the present invention allows for convenient access to the smoking article, and helps to avoid its contact with dirt, chemicals and insects. The smoking article holder further helps to prevent the loss of the smoking article. The holder is, further, simple in construction, inexpensive to manufacture, and capable of a long life of useful service with a minimum of maintenance.

It is obvious that minor changes may be made in the form and construction of the invention without departing from the material spirit thereof. It is not, therefore, desired to confine the invention to the exact form herein shown and described, but it is desired to include all such as properly come within the scope claimed.

The invention having been thus described, what is claimed as new and desired to secure by Letters Patent is:

1. A smoking article holder, for use with a golf tee having a head portion, and for use with a smoking article, said holder comprising:

(a) a generally oblong upper member having an elongated, concave upper surface and a lower surface, said upper surface being adapted for receiving at least a part of the smoking article, and (b) a lower member, depending from said lower surface of said upper member, intermediate the length thereof, said lower member being adapted to receive at least a part of the head portion of the golf tee.

2. A smoking article holder as recited in claim 1, wherein the said lower member includes at least two opposed and undercut lips which engage opposite sides of the head portion of the tee to firmly connect the head portion of the tee to the said lower member.

3. A smoking article holder as recited in claim 2 having a third undercut lip adapted to engage another side of said head portion of said golf tee, further connecting the head portion of the golf tee to the lower member.

4. A smoking article holder as recited in claim 1 wherein:

(a) the lower member has a cylindrical body with a central longitudinal axis that is at right angles to the central longitudinal axis of the upper member, (b) a large bore is provided along the central longitudinal axis of the cylindrical body commencing at a point adjacent the juncture of the cylindrical body and the upper member and extending downward a distance approximately equal to the height of the upper cylindrical portion of the head portion of the tee, and the diameter of the large bore closely corresponding to the diameter of the upper cylindrical portion of the head portion of the tee, (c) commencing at the lower end of the large bore and contiguous therewith a small bore extends downward along the central longitudinal axis to the lower most point of the cylindrical body, the small bore being configured in dimension to receive at least a part of the tapered portion of the head portion of the tee, (d) the juncture of the large bore and the small bore providing a shoulder for seating the lower surface of the upper cylindrical portion of the head portion of the tee, and (e) a cutout on the side of the cylindrical body allowing for lateral access to the small bore and the large bore, the cutout being dimensioned and configured to allow lateral passage of the upper cylindrical portion of the head portion of the tee into the large bore and lateral passage of at least a portion of the inwardly tapered portion of the head portion of the tee into the small bore, when a portion of the cylindrical body adjacent the cutout is resiliently deflected to slightly expand the size of the cutout.

5. A smoking article holder, for use with an elongated shaft having a head portion and for use with a smoking article, said holder comprising:

(a) a generally oblong upper member having an elongated, concave upper surface and a lower surface, said upper surface being adapted for receiving at least a pan of the smoking article, and (b) a lower member, depending from said lower surface of said upper member, intermediate the length thereof, said lower member being adapted to receive at least a part of the head portion of the shaft.

6. A smoking article holder as recited in claim 5, wherein the said lower member includes at least two opposed and undercut lips which engage opposite sides of the head portion of the shaft to firmly connect the head portion of the shaft to the said lower member.

7. A smoking article holder as recited in claim 6 having a third undercut lip adapted to engage another side of said head portion of said shall, further connecting the head portion of the shaft to the lower member.

8. A smoking article holder as recited in claim 5 wherein:

(a) the lower member has a cylindrical body with a central longitudinal axis that is at right angles to the central longitudinal axis of the upper member, (b) a large bore is provided along the central longitudinal axis of the cylindrical body commencing at a point adjacent the juncture of the cylindrical body and the upper member and extending downward a distance approximately equal to the height of the upper cylindrical portion of the head portion of the shaft, and the diameter of the large bore closely corresponding to the diameter of the upper cylindrical portion of the head portion of the shaft, (c) commencing at the lower end of the large bore and contiguous therewith a small bore extends downward along the central longitudinal axis to the lower most point of the cylindrical body, the small bore being configured in dimension to receive at least a part of the tapered portion of the head portion of the shaft, (d) the juncture of the large bore and the small bore providing a shoulder for seating the lower surface of the upper cylindrical portion of the head portion of the shaft, and (e) a cutout on the side of the cylindrical body allowing for lateral access to the small bore and the large bore, the cutout being dimensioned and configured to allow lateral passage of the upper cylindrical portion of the head portion of the shaft into the large bore and lateral passage of at least a portion of the inwardly tapered portion of the head portion of the shaft into the small bore, when a portion of the cylindrical body adjacent the cutout is resiliently deflected to slightly expand the size of the cutout.

* * * * *